US007406848B2

(12) United States Patent
Bumi

(10) Patent No.: US 7,406,848 B2
(45) Date of Patent: Aug. 5, 2008

(54) EMERGENCY DOOR OPENING TOOL SET AND METHOD FOR OPENING A DOOR IN AN EMERGENCY

(76) Inventor: Hussain Bumi, Bayan, P.O. Box 66184, Bayan (KW)

( * ) Notice: Subject to any disclaimer, the term of this patent is extended or adjusted under 35 U.S.C. 154(b) by 0 days.

(21) Appl. No.: 11/554,262

(22) Filed: Oct. 30, 2006

(65) Prior Publication Data

US 2008/0100067 A1 May 1, 2008

(51) Int. Cl.
*E05B 63/09* (2006.01)

(52) U.S. Cl. ..... 70/465; 70/417; 29/426.4

(58) Field of Classification Search ..... 70/465, 70/417; 29/426.4, 426.5; 411/190–192, 411/197, 204; 292/156
See application file for complete search history.

(56) References Cited

U.S. PATENT DOCUMENTS 4,057,890 A * 11/1977 Feen ..... 29/426.4
4,059,883 A * 11/1977 Osborne ..... 29/259
4,074,548 A * 2/1978 Milton ..... 70/1.5
4,098,100 A * 7/1978 Wah ..... 70/38 A
4,261,093 A * 4/1981 Steffen et al. ..... 29/426.4
4,307,983 A * 12/1981 Blough et al. ..... 408/72 B
4,339,863 A * 7/1982 Block ..... 29/426.4
4,586,233 A * 5/1986 Markisello ..... 29/426.4
4,682,398 A * 7/1987 Markisello ..... 29/426.4
5,402,661 A * 4/1995 Markisello ..... 70/394
5,454,245 A * 10/1995 Markisello ..... 70/252
5,653,337 A * 8/1997 Cirigliano ..... 206/373
5,713,225 A * 2/1998 Smith ..... 70/51
2004/0177662 A1* 9/2004 Bosse ..... 70/465
2006/0260111 A1* 11/2006 Russell ..... 29/426.4

* cited by examiner

*Primary Examiner*—Suzanne D Barrett
(74) *Attorney, Agent, or Firm*—Lowe Hauptman; Ham & Berner, LLP

(57) ABSTRACT

An emergency door opening tool set includes a screwdriver for removing a latch assembly cover plate, a second and a third tool for opening a locked door. The second tool includes an elongated bar with a mass of metal at one end thereof and an opening or recess in the shape of an outwardly projecting portion of the lock. A transverse force is applied to the elongated bar to break off the outwardly projection of the lock. The third tool includes an elongated bar, a T-shaped handle at one end thereof and a latch turning element at the opposite end. After removal of the broken off portion of the lock the third tool is inserted into the lock assembly and turned to retract a latch bolt from the striker plate. The set also includes a pouch or bag to carry the tool set.

4 Claims, 2 Drawing Sheets

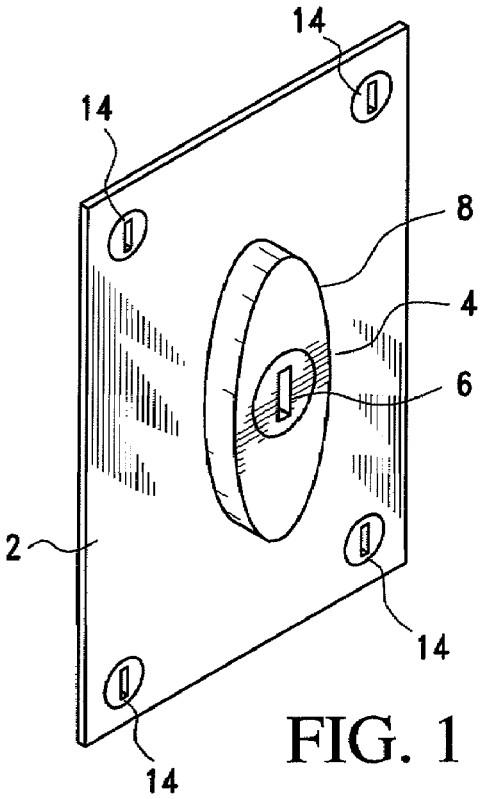
FIG. 1
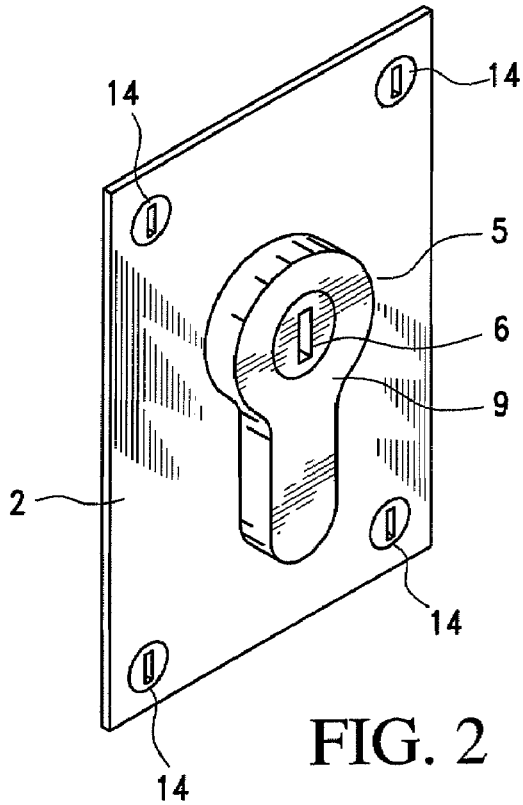
FIG. 2
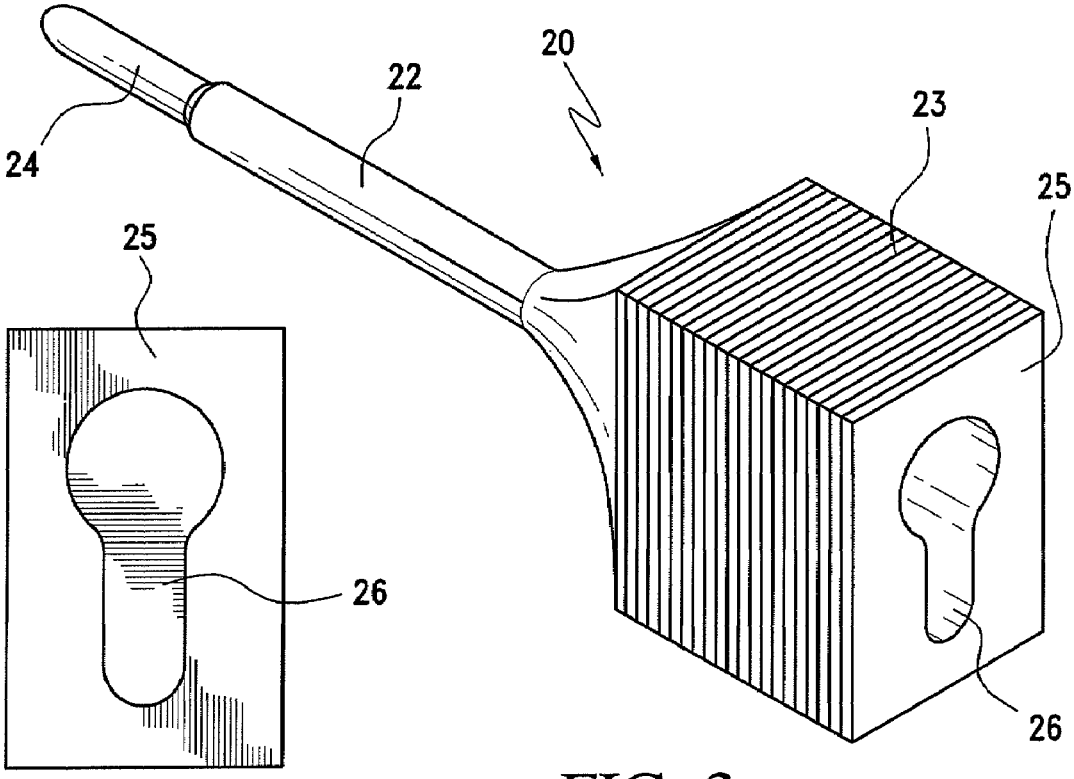
FIG. 3
FIG. 3A

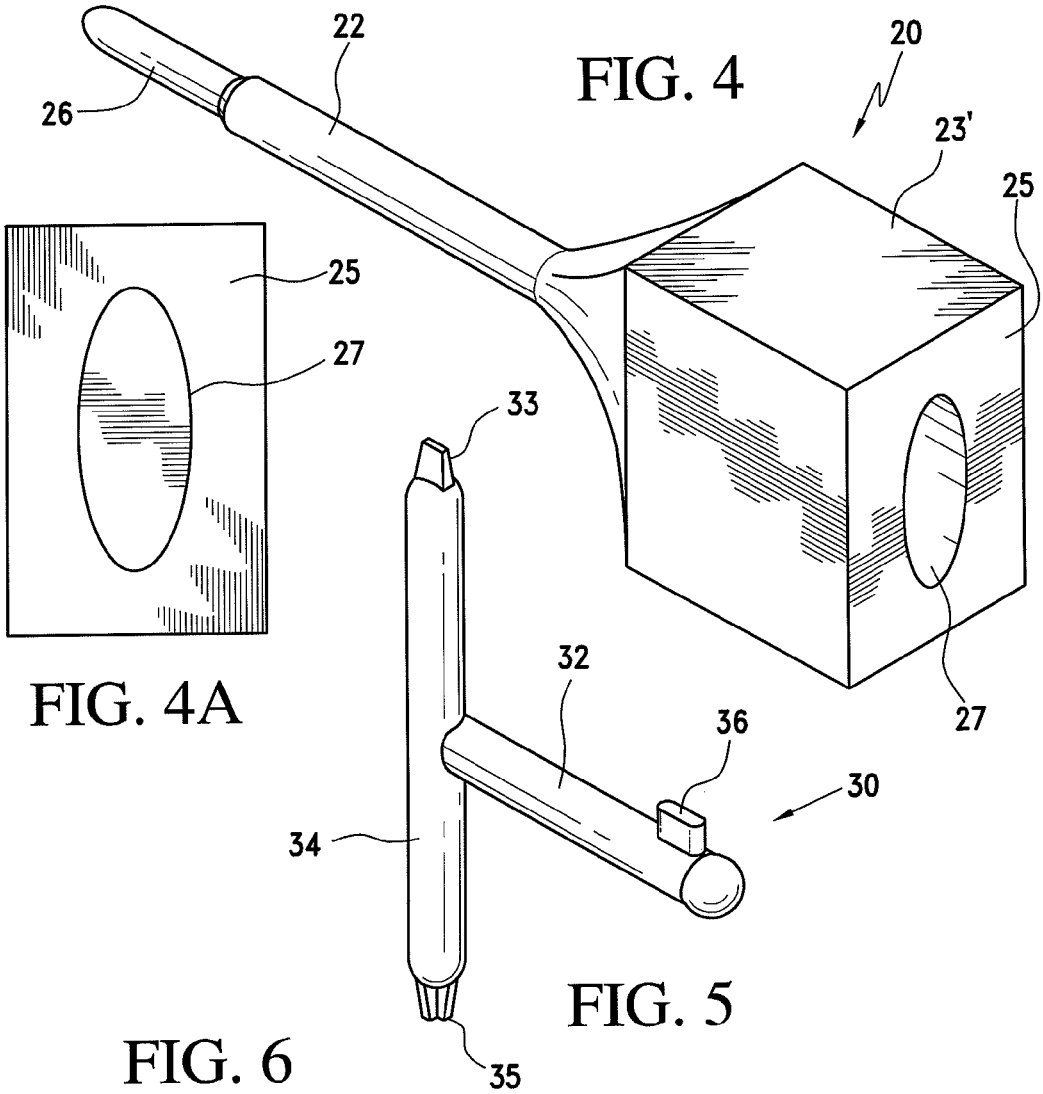
FIG. 4
FIG. 4A
FIG. 5
FIG. 6
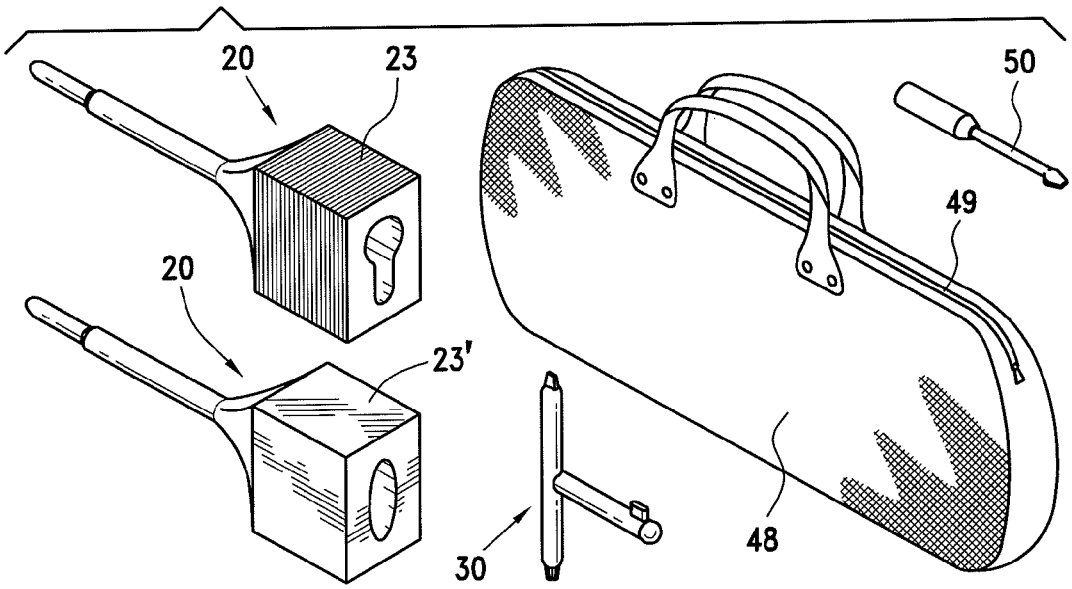

EMERGENCY DOOR OPENING TOOL SET AND METHOD FOR OPENING A DOOR IN AN EMERGENCY

FIELD OF THE INVENTION

This invention relates to an emergency door opening tool set and method for opening a door in an emergency and more particularly to an emergency door opening tool set and method for opening a locked door without damage to the door.

BACKGROUND FOR THE INVENTION

In emergency situations, rapid access to a structure through a locked door maybe critical. For example, Emergency Medical Technicians (EMTs), fireman and policeman may need access to a locked building. In many such cases, the EMTs, fireman and police may enter the building by means of a battering ram, pry bar, lock cutter and cutting and removal tools and the like. Some of these approaches result in the destruction of a door. Other approaches focus on the lock mechanism.

For example, a U.S. Pat. No. 4,597,123 of Cobe, Jr. discloses a combination firefighter's tool. As disclosed therein, the tool includes an elongate handle, one end of which tapers into a wedge shape that is used for prying. The other end includes an arcuate portion with inwardly angled projections creating a spanner wrench for use with hose couplings. One side of the arcuate portion includes a cylindrical member with a flat face suited for a hammering operation. The other end of the arcuate portion includes claw members diverging from a narrow portion proximal the arcuate member and cooperates with the arcuate member in a prying operation. A pin member extends in a plane perpendicular to the plane formed by the elongate handle and the arcuate member and is located for use in removing hinge pins from doors.

A more recent Patent Application Publication No. 2004/01776662 of Bosse discloses a Lock Removal Tool. As disclosed therein, a lock removal tool is a forcible entry tool designed to facilitate forcible entry through a locked door or other barricaded entry ways during an emergency situation. The lock removal door comprises an elongated bar having a lock cutting tool on one end and a tool piece such as a screw driver or allen wrench extending from the other end. A slide hammer mechanism having first and second impact collars fixed near the ends of the bar and a weight slideably disposed on the bar between the impact collars allows a significant force to be imparted to the lock cutting tool. The lock cutting tool itself is a flat metal plate with a bifurcated leading edge, the bifurcation forming a lock cutting slot. The leading edge is tapered to allow the lock cutting tool to be inserted underneath a door knob or locked base palte.

Notwithstanding the above, it is presently believed that there is a need and maybe a commercial market for an emergency door opening tool set in accordance with the present invention. There should be a need because such sets are primarily designed for use with a particular type of lock as widely used in Kuwait. Further, such tool sets can be used to gain access to a room or structure through a locked door with little or no damage to the door and minimal damage to a lock assemble. Further, such sets are durable, relatively compact, relatively inexpensive to manufacture and relatively easy to carry and store in an inexpensive carrier such as a fabric bag.

BRIEF SUMMARY OF THE INVENTION

In essence, the present invention contemplates an emergency door opening tool set for EMT's, fireman and police. The tool set includes a first tool such as a screwdriver for removing an outer cover or face plate that covers a lock assembly. The tool set also includes a second tool comprising an elongated bar and a metal block disposed at one end of the elongated bar. The metal block preferably has a cube shape with a face surface that defines a recess or opening having the shape of an outwardly projecting lock member. This recess is adapted to fit over the outwardly projecting lock member in close proximity to or slidable engaging the sides of the outwardly projecting locking member. Applying lateral force, the elongated bar breaks the outwardly projecting locking member which can then be readily removed from the lock assembly. The tool set also includes a third tool which includes an elongated bar and a T-shaped handle at one end thereof. A latch turning element is provided at the opposite end for insertion into an opening remaining after breaking and removing the outwardly projecting lock member and rotating the third tool to retract a latch bolt out of a strike plate. In this way, the door can be opened without damage to the door.

The invention also contemplates a method which includes the steps of providing the three tools as set forth above. The method then includes the step of using the screwdriver or the like to remove a cover plate from the outer surface of a door. The second tool is then positioned with the recess or opening in the metal block encompassing the outwardly projecting lock member and a lateral force is applied to the elongated bar to break off the outwardly projecting lock member. The broken off piece of the lock member is discarded and the third tool is used to retract a latch bolt so that the door can be opened without damage to the door or door frame.

The invention will now be described in connection with the following figures wherein like reference numerals have been used to designate like parts.

DESCRIPTION OF THE DRAWINGS

FIG. 1 is a perspective view of a lock cover plate and a portion of a lock assembly which may be broken to gain access to a structure or room in an emergency situation;

FIG. 2 is a perspective view of a lock cover plate and portions of a lock assembly of a different type than the one shown in figure one;

FIG. 3 is a perspective view of a second tool of a tool set in accordance with the present invention;

FIG. 3A is a cross-sectional view along the lines 3-3 of the tool shown in FIG. 3;

FIG. 4 is a perspective view of a second tool of a tool set in accordance with a second embodiment of the invention;

FIG. 4A is a cross-sectional view along the lines 4-4 in FIG. 4;

FIG. 5 is perspective view of a third tool of a tool set in accordance with the present invention; and FIG. 6 is a view of a carry bag for transporting a tool set in accordance with the present invention.

DESCRIPTION OF THE PREFERRED EMBODIMENTS OF THE INVENTION

FIGS. 1 and 2 illustrate key elements of a typical door lock of types which are widely used in Kuwait, probably other countries in the Middle East and possibly in areas of Europe and the United States. Such locks include a cover plate 2 and a central lock portion 4 (FIG. 1) and 5 (FIG. 2) that unlock the lock by means of a key (not shown) and a keyhole 6. Unlocking the lock allows a reciprocal latch bolt to be moved into and out of a strike plate in a conventional manner. Locks of this type typically extend slightly outwardly from the cover plate and include an elongated relatively shallow oval or key hole shaped element 8 (FIG. 1) and 9 (FIG. 2) and extend from one side of a door to the other side. As shown each of the elements 8 and 9 are divided into two parts with upper and lower connecting members 10 and 12 respectively.

The cover plates 2 are fastened to a door with a plurality of wood screws 14 which are easily removed with a conventional screwdriver 50 (FIG. 6) or a flat blade 33 on a third tool 30 (FIG. 5). Removal of the cover plate leaves a relatively large portion of the element 8 or element 9 exposed for engagement by a portion of a second tool 20. For example, a key shaped opening or recess 24 maybe slipped over the key shaped element 8.

The second tool 20 includes an elongated bar 22 with a generally cube shaped metal mass 23 at one end of the elongated bar 22. A suitable handle 24 is disposed at the opposite end of the elongated bar 22. The metal mass 23 may be in the form of a cast medal block or a plurality of metal sheets fixed together in a conventional manner. For example, the metal sheets may be held together by one or more bolts, spot welding, soldering or the like.

The cube shaped metal mass 23 and 23' also include a front surface 25 that defines a key shaped recess 26 (as shown in FIGS. 3 & 3A) or generally oval shaped recessed 27 (as shown in FIGS. 4 & 4A). The use of multiple shapes to form the metal mass 23 allows the recess or opening 26 to be stamped into each sheet and only in those sheets that extend from the first surface rearwardly for about ¾ of an inch. By contrast a suitable plug or form may be used in forming a casting with a generally oval shaped recess or opening 27.

A third tool 30 is illustrated in FIG. 5 and includes an elongated bar 32 and T-shaped handle 34. A flat blade 33 which allows the handle to be used as a screwdriver is shown at one end of the T-shaped handle 34 even though it is contemplated to use a separate screwdriver 50 as illustrated in FIG. 6. A Philips head screwdriver 35 is shown at an opposite end of the T-shaped handle 34. In the preferred embodiment of the invention a separate screwdriver 50 is provided and the ends of the T-shaped handles are rounded.

The third tool 30 also includes a latch turning element 36 at a forward end of the elongated bar 32. The element 36 projects outwardly at a 90° angle and are adapted to retract a striker bolt by rotation of the T-shaped handle 34 after insertion into the lock assembly.

FIG. 6 illustrates a cloth bag 48 for carrying the tool set and includes a heavy duty zipper 49 or other suitable means for closing the bag 48.

While the invention has been described in connection with its preferred embodiments it should be recognized that changes and modifications can be made therein without departing from the scope of the appended claims.

What is claimed is:

1. An emergency door opening tool set comprising:

a first tool for removing a cover plate and a second tool comprising an elongated bar and a cube shaped metal block disposed at one end of said elongated bar and said metal block having a front surface defining a generally oval or key shaped recess adapted to fit over an outwardly projecting lock member with two sides in close proximity to the two sides thereof so that a lateral force on said elongated bar breaks the outwardly projecting lock member, and a third tool comprising an elongated bar and a T-shaped handle at one end thereof and a latch turning element at an opposite end thereof for insertion into an opening remaining after breaking and removing of the outwardly projecting lock member for retracting a latch bolt from a strike plate and wherein said latch turning element projects laterally from said bar of said tool at an opposite end thereof at an angle of about 90°; and in which said first tool for removing a cover plate is integral with one end of said T-shaped handle.

2. An emergency door opening tool set according to claim 1 in which said metal block includes a plurality of superimposed metal sheets fixed together.

3. An emergency door opening tool set according to claim 1 which includes a cloth bag for carrying said tool set.

4. An emergency door opening tool set according to claim 1 which includes a Phillips Head screwdriver at an opposite end of said handle.

* * * * *

UNITED STATES PATENT AND TRADEMARK OFFICE

CERTIFICATE OF CORRECTION

PATENT NO. : 7,406,848 B2
APPLICATION NO. : 11/554262
DATED : August 5, 2008
INVENTOR(S) : Hussain Bumijdad It is certified that error appears in the above-identified patent and that said Letters Patent is hereby corrected as shown below:

On the Title page the Inventor's name should read as follows:

-- (76) Inventor: Hussain Bumijdad, P.O. Box 66184, Bayan (KW) --

Signed and Sealed this

Sixth Day of January, 2009

JON W. DUDAS
*Director of the United States Patent and Trademark Office*